US005484462A

United States Patent [19]

Herbstman

[11] Patent Number: 5,484,462

[45] Date of Patent: Jan. 16, 1996

[54] LOW SULFUR DIESEL FUEL COMPOSITION WITH ANTI-WEAR PROPERTIES

[75] Inventor: Sheldon Herbstman, New City, N.Y.

[73] Assignee: Texaco Inc., White Plains, N.Y.

[21] Appl. No.: 309,693

[22] Filed: Sep. 21, 1994

[51] Int. Cl.[6] ..... C10L 1/22

[52] U.S. Cl. ..... 44/334

[58] Field of Search ..... 44/334

[56] References Cited

U.S. PATENT DOCUMENTS

| | | | |
|---|---|---|---|
| 2,784,067 | 3/1957 | Duncan et al. | 44/334 |
| 3,019,196 | 1/1962 | Andersen et al. | 44/334 |
| 3,156,687 | 11/1964 | Andersen et al. | 44/334 |
| 3,864,098 | 2/1975 | Honnen | 44/334 |
| 3,989,476 | 11/1976 | Abbott | 44/334 |
| 4,209,302 | 6/1980 | Orelup | 44/334 |
| 4,234,321 | 11/1980 | Lilburn | 42/72 |
| 4,357,148 | 11/1982 | Graiff | 44/62 |
| 4,412,846 | 11/1983 | Abbott | 44/334 |
| 4,581,040 | 4/1986 | Sung et al. | 44/71 |
| 4,604,103 | 8/1986 | Campbell | 44/72 |
| 4,631,069 | 12/1986 | Sung | 44/56 |
| 4,643,738 | 2/1987 | Sung et al. | 44/63 |
| 4,659,336 | 4/1987 | Sung et al. | 44/62 |
| 4,659,337 | 4/1987 | Sung | 44/63 |
| 4,692,268 | 9/1987 | Lundberg et al. | 44/334 |
| 4,747,851 | 5/1988 | Sung et al. | 44/72 |
| 4,919,685 | 4/1990 | Herbstman et al. | 44/334 |
| 5,234,478 | 8/1993 | Su et al. | 44/419 |

FOREIGN PATENT DOCUMENTS

| | | | |
|---|---|---|---|
| 0297996 | 4/1989 | European Pat. Off. | 10/133 |

*Primary Examiner*—Ellen M. McAvoy

*Attorney, Agent, or Firm*—Kenneth R. Priem; George J. Darsa; Christopher Nicastri

[57] ABSTRACT

A fuel composition comprising a mixture of hydrocarbons boiling in the range from about 320° F. to 620° F. and a sulfur content of about 0.05 wt. %, or below, containing from about 1 to about 20 PTB of aminoalkylmorpholine having the formula:

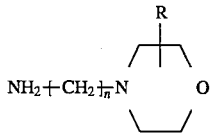

where R is hydrogen of a $C_1$–$C_{10}$ alkyl radical, and n is a number between 2 and about 10.

12 Claims, No Drawings

LOW SULFUR DIESEL FUEL COMPOSITION WITH ANTI-WEAR PROPERTIES

BACKGROUND OF THE INVENTION

1. Field of the Invention

The present invention relates to a low sulfur diesel fuel composition having anti-wear properties. More specifically, the present invention relates to a low sulfur diesel fuel composition containing an amount of aminoalkylmorpholine effective to reduce wear to engine parts making metal to metal contact.

2. Description of Related Information

In response to ecological concerns, fuel companies have been selling low sulfur fuel oils nationwide since 1991. Combustion of sulfur containing fuels produces sulfur oxides, $SO_x$, which reduce air quality and also fall to the ground in the form of acid rain. By removing sulfur from diesel fuels, or by using diesel fuels which are naturally low in sulfur, fuel companies have contributed to the cleanup of the air and waterways.

The use of low sulfur diesel fuels has had the side effect of increasing wear inside diesel engines at points which are lubricated by the fuel oil, and, more particularly, at light duty contact points in fuel injectors and pumps. Sulfur containing molecules react with metal surfaces to provide more efficient wear protection during metal to metal contact under high pressure rolling point content. The increasing use of low sulfur content diesel fuels will cause increased wear problems in fuel injectors and other moving metal parts which come in contact with this type of fuel.

For the foregoing reasons, refiners have resorted to adding lubricity agents to low sulfur diesel fuels to reduce wear in injectors and pumps. A problem associated with commercial lubricity agents, however, is that some of these agents are acidic. For example, one commercially available lubricity agent contains dimerized linoleic acid. These acids can react with basic amines, which are typically used as detergent additives in diesel fuels, to form harmful precipitates in the fuel. It would be useful, therefore, to provide a basic lubricity additive which would avoid these undesirable side reactions.

Applicant has discovered a basic, organic fuel additive which increases the lubricity of low sulfur diesel fuels and reduces the wear of moving metal parts which come in contact with the fuel in a diesel engine. This basic, organic fuel additive will not react with the basic, amine detergent additives to form precipitates, and thus overcomes this problem faced by the prior attempts to increase lubricity of low sulfur diesel fuels.

SUMMARY OF THE INVENTION

The present invention provides a fuel composition comprising a mixture of hydrocarbons boiling in the range from about 320° F. to 620° F., having a sulfur content of about 0.05 wt. % or below, and containing from about 1 to about 20 PTB of an aminoalkylmorpholine, having the formula:

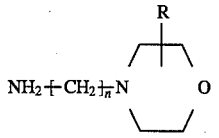

where R is hydrogen or a $C_1$–$C_{10}$ alkyl radical, and n is a number between about 2 and about 10.

In another embodiment, the present invention provides a method for producing a low sulfur diesel fuel composition having anti-wear properties which comprises adding from about 1 to about 20 PTB of the aminoalkylmorpholine to a hydrocarbon fuel composition boiling in the range from about 320° F. to 620° F. and having a sulfur content of about 0.05 wt. %, or below.

The basic lubricity agent of the present invention provides an excellent increase in lubricity without the formation of precipitates which can occur through the use of acidic lubricity agents.

DETAILED DESCRIPTION OF THE INVENTION

The diesel fuel composition of the invention comprises a major portion of a mixture of hydrocarbons boiling in the diesel boiling range, containing a minor amount, effective to impart anti-wear properties to the mixture, of an aminoalkylmorpholine, having the formula:

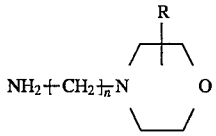

where R is hydrogen or a $C_1$–$C_{10}$ alkyl radical, and n is a number between about 2 and about 10. Preferably R is hydrogen, and n is a number between about 2 and about 5. More preferably n is about 3.

Aminoalkylmorpholine is a basic organic compound which contains both primary and tertiary amine functions as well as an ether linkage. While not bound to any particular theory, Applicant hypothesizes that this amine/ether improves fuel lubricity because of its unique set of chemical functionality, i.e., the combination of the morpholine and the alkylamine structures.

More specifically, the fuel composition of the invention will comprise a mixture of hydrocarbons boiling in the range of 320° F. to 620° F. having a sulfur content of about 0.05 wt.%, or below, and will contain from about 1 to about 20 PTB, preferably about 5 to about 10 PTB, and more preferably about 7 to about 9 PTB, of the prescribed anti-wear agent aminoalkylmorpholine.

The anti-wear agent can be synthesized by any suitable means. A preferred method for synthesizing the preferred aminopropylmorpholine of the present invention is to react morpholine with acrylonitrile in the presence of a base according to the following equation:

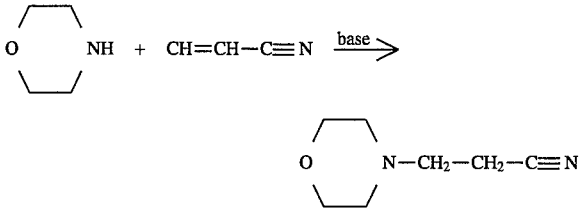

followed by addition of hydrogen in the presence of a copper catalyst to provide the amine:

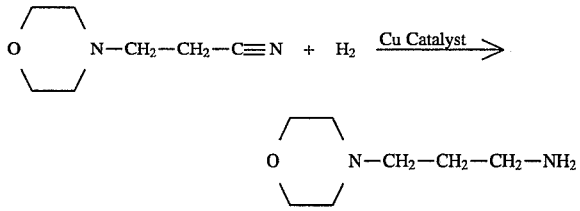

EXAMPLE I

Preparation of Aminopropylmorpholine

One mole of morpholine is reacted with 1.1 moles of acrylonitrile, added at about 28° C. with about 0.05 moles of a basic triamine, such as triethylamine, as a catalyst. The reaction is exothermic. After stirring for about 5 hours, the reaction mixture is distilled free of unreacted acrylonitrile. The resulting acrylonitrile adduct is reduced to the amine at 100° C. –150° C. under 1000 psig hydrogen using a copper catalyst. The resulting product is distilled to purity.

The hydrocarbon fuel composition of the invention consists of a hydrocarbon fraction boiling in the diesel boiling range. The base fuel may consist of paraffinic, naphthenic and/or aromatic hydrocarbons or mixtures thereof suitable for use in a diesel ignition internal combustion engine. The base fuels are obtained from the distillation of crude oil, by the catalytic or thermal cracking of gas oils, by the alkylation of isoparaffins with olefins, or by the polymerization of olefins. The boiling range of the base fuel will be in the range from about 320° F. to 620° F. The base fuel composition may also contain additives conventionally employed in diesel fuels, such as anti-oxidants, stabilizers, dyes, anti-icing additives and the like.

The additive of the present invention is soluble in diesel fuel and can be added to diesel fuel in any manner.

The fuel compositions of the invention were tested for their anti-wear effectiveness according to the Ball on Cylinder Lubricity Evaluator (BOCLE) (ASTM D 5001 ). The ball on cylinder lubricity evaluator assesses the wear aspects of the boundary lubrication properties of the diesel fuel composition. The fluid under test is placed in a test reservoir in which atmospheric air is maintained at 10% relative humidity. A non-rotating steel ball is held in a vertically mounted chuck and forced against an axially mounted steel ring with an applied load. The test cylinder is rotated at a fixed speed while being partially immersed in the fluid reservoir. This maintains the cylinder in a wet condition and continuously transports the test fluid to the ball/cylinder interface. The wear scar generated on the test ball is a measure of the fluid lubricating properties.

In Examples A–E the test cylinder was rotated at a speed of 240 rpm, partially immersed in the fuel compositions tested. A steel ball was held stationary and forced against the rotating cylinder with an applied load of 1000 g for 30 minutes. A new steel ball was used for each example. At the end of each test the diameter of the scar on the steel ball was measured. The results are reported below in Table II.

The properties of the base fuel employed in Example A–E are described in Table I.

TABLE I

| Base Fuel | |
|---|---|
| S | 6 ppm |
| Fluorescence Indicator Absorption | |
| | Vol. % |
| Aromatics | 23.3 |
| Olefins | 2.3 |
| Saturates | 74.4 |
| Distillation | |
| Vol. % | °F. |
| IBP | 339 |
| 10 | 394 |
| 50 | 480 |
| 90 | 618 |
| EP | 670 |

The test results of Example's A–E are summarized in Table II.

TABLE II

| EXAMPLE | Fuel Composition | END OF TEST SCAR DIAMETER, mm |
|---|---|---|
| 1 | Base Fuel (BF) | 0.64 |
| 2 | BF + 150 PTB Commercial Detergent Additive Package | 0.65 |
| 3 | Example 2 Fuel + 0.8% Cetane Improver | 0.67 |
| 4 | Example 3 Fuel + 8 PTB aminopropylmorpholine | 0.58 |
| 5 | Example 3 Fuel + 8 PTB Commercial lubricity agent | 0.60 |

The data indicate that the introduction of the commercial detergent additive package into the base fuel does not decrease or significantly increase the scar diameter of the test. Neither does the introduction of cetane improver. In order to reduce the scar diameter of the base fuel plus detergent additive package and cetane improver, a lubricity agent such as the commercial lubricity agent or the lubricity agent of the present invention was added. The test data show that the additive of the present invention provides better lubricity results than does the commercial lubricity agent. In addition, the additive of the present invention will not form precipitates with the detergent additive package as could the acidic, commercial lubricity agent. The data show that the anti-wear additive of the present invention is an effective lubricity agent for low sulfur content diesel fuels.

We claim:

1. A fuel composition comprising a mixture of hydrocarbons boiling in the range from about 320° F. to 620° F. and a sulfur content of about 0.05 wt. %, or below, containing from about 1 to about 20 PTB of aminoalkylmorpholine of formula:

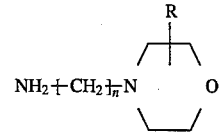

where R is hydrogen or a $C_1$–$C_{10}$ alkyl radical, and n is a number between about 2 and about 10.

2. The fuel composition of claim 1 where n is a number between about 2 and about 5.

3. The fuel composition of claim 1 where n is 3.

4. The fuel composition of claim 1 where R is hydrogen.

5. The fuel composition of claim 1 containing from about 5 to about 10 PTB of aminoalkylmorpholine.

6. The fuel composition of claim 1 containing from about 7 to about 9 PTB of aminoalkylmorpholine.

7. A method for producing a low sulfur diesel fuel composition having anti-wear properties which comprises adding from about 1 to about 20 PTB of aminoalkylmorpholine of formula:

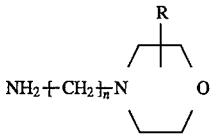

where R is hydrogen or a $C_1$–$C_{10}$ alkyl radical, and n is a number between about 2 and about 10, to a hydrocarbon fuel composition boiling in the range from about 320° F. to 620° F. and having a sulfur content of about 0.05 wt. %, or below.

8. The method of claim 7 where n is a number between about 2 and about 5.

9. The method of claim 7 where n is 3.

10. The method of claim 7 where R is hydrogen.

11. The method of claim 7 wherein the aminoalkylmorpholine is added in an amount between about 5 and 10 PTB.

12. The method of claim 7 wherein the aminoalkylmorpholine is added in an amount between about 7 and about 9 PTB.

* * * * *